US011085645B2

(12) United States Patent
Cadima

(10) Patent No.: US 11,085,645 B2
(45) Date of Patent: Aug. 10, 2021

(54) EDUCTOR FOR A GAS COOKTOP APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 371 days.

(21) Appl. No.: 15/993,741

(22) Filed: May 31, 2018

(65) Prior Publication Data

US 2019/0368739 A1 Dec. 5, 2019

(51) Int. Cl.

| | |
|---|---|
| ***F23R 3/28*** | (2006.01) |
| ***F24C 15/00*** | (2006.01) |
| ***F24C 3/08*** | (2006.01) |
| ***F23D 14/06*** | (2006.01) |

(52) U.S. Cl.

CPC ..... *F23R 3/286* (2013.01); *F23D 14/06* (2013.01); *F24C 3/082* (2013.01); *F24C 15/001* (2013.01)

(58) Field of Classification Search

None

See application file for complete search history.

(56) References Cited

U.S. PATENT DOCUMENTS 545,769 A * 9/1895 Bowman ..... F16K 5/12 251/209
737,632 A * 9/1903 Jennings ..... F16K 1/523 251/285
865,183 A * 9/1907 Kaufman ..... F24C 3/085 126/39 R
1,461,663 A * 7/1923 Kemmer ..... F23D 14/085 431/280
1,473,716 A * 11/1923 Willcox ..... F23G 7/085 431/256
1,664,508 A * 4/1928 Harper ..... F23D 14/085 431/280

(Continued)

FOREIGN PATENT DOCUMENTS

CN 2076201 5/1991
CN 2146657 11/1993

(Continued)

OTHER PUBLICATIONS

International Search Report, PCT Application No. PCT/CN2019/089074, dated Aug. 7, 2019, 2 pages.

*Primary Examiner* — Avinash A Savani
*Assistant Examiner* — Martha M Becton
(74) *Attorney, Agent, or Firm* — Dority & Manning, P.A.

(57) ABSTRACT

An eductor for a gas burner includes a mixing body that defines a mixing chamber. The mixing body also has a fuel line coupling. The mixing chamber is configured for receiving a flow of forced air and a flow of fuel. The fuel line coupling is configured for supporting a fuel line through which the flow of fuel enters the mixing body. A fuel metering orifice is mounted to the mixing body. The fuel metering orifice is spaced from the fuel line coupling on the mixing body. The fuel metering orifice is configured for directing the flow of fuel into the mixing chamber of the mixing body. The fuel metering orifice is separable from the mixing body when the fuel line is coupled to the mixing body at the fuel line coupling.

20 Claims, 5 Drawing Sheets

(56) References Cited

U.S. PATENT DOCUMENTS 2,383,641 A * 8/1945 Focke ..... F23N 1/005 236/75
2,497,787 A * 2/1950 Minster ..... F23D 14/06 126/39 N
3,455,290 A * 7/1969 Kemp ..... F23D 14/04 126/39 H
3,627,462 A * 12/1971 Lotter ..... F23D 14/06 431/284
3,747,629 A * 7/1973 Bauman ..... G05D 16/0661 137/270
3,825,402 A * 7/1974 Duperow ..... F23D 14/04 239/568
4,424,793 A 1/1984 Cooperrider
5,002,038 A * 3/1991 Riehl ..... F23D 14/06 126/39 H
5,085,202 A * 2/1992 Riehl ..... F24C 3/085 126/39 R
5,133,334 A * 7/1992 Riehl ..... F23D 14/06 126/39 R
5,149,262 A * 9/1992 Riehl ..... F23D 14/06 126/39 H
5,160,255 A * 11/1992 Sigler ..... F23Q 3/006 126/39 E
5,160,256 A * 11/1992 Riehl ..... F24C 3/103 126/39 BA
5,266,026 A * 11/1993 Riehl ..... F23D 14/06 126/39 E
5,328,357 A * 7/1994 Riehl ..... F23D 14/06 126/39 E
5,775,309 A * 7/1998 Burrahm ..... F02D 19/0647 123/527
5,924,860 A * 7/1999 Massey ..... F24C 3/103 126/39 E
5,961,311 A * 10/1999 Moore, Jr. ..... F24C 3/103 431/6
6,030,207 A * 2/2000 Saleh ..... F24C 3/085 431/354
6,068,017 A * 5/2000 Haworth ..... F02D 19/0647 123/527
6,263,868 B1 * 7/2001 Koch ..... F23D 14/06 126/39 E
6,325,619 B2 * 12/2001 Dane ..... F23D 14/065 126/39 E
6,435,863 B2 * 8/2002 Damrath ..... F24C 3/085 126/39 E
6,537,065 B1 3/2003 Shirali et al.
6,780,008 B2 * 8/2004 Koch ..... F23D 14/065 126/39 R
6,851,420 B2 * 2/2005 Jennings ..... F23D 14/045 126/39 R
7,001,176 B2 * 2/2006 Bettinzoli ..... F23D 14/065 126/39 R
7,083,123 B2 * 8/2006 Molla ..... F23D 14/06 239/267
7,967,005 B2 * 6/2011 Parrish ..... F23N 1/007 126/42
8,206,148 B2 * 6/2012 Paesani ..... F23D 14/26 431/284
8,511,294 B2 * 8/2013 Paesani ..... F23D 14/06 126/39 E
9,115,892 B2 * 8/2015 Bettinzoli ..... F23D 14/82
9,297,537 B2 * 3/2016 Hensley ..... F23D 23/00
9,347,670 B2 * 5/2016 Cadima ..... F24C 3/085
9,488,283 B2 * 11/2016 Cadima ..... F16K 5/0407
RE46,600 E * 11/2017 Albizuri ..... G01F 15/002
9,909,758 B2 * 3/2018 Biagioli ..... F23D 14/06
10,036,557 B2 * 7/2018 Ceccoli ..... F23D 23/00
10,317,086 B2 * 6/2019 Acosta Herrero ..... F24C 3/085
10,415,824 B2 * 9/2019 Cadima ..... F23D 14/065
10,551,057 B2 * 2/2020 Trochou ..... F23D 14/06
2001/0010897 A1 * 8/2001 Dane ..... F24C 3/085 431/266
2001/0014437 A1 * 8/2001 Damrath ..... F24C 3/085 431/354
2003/0024525 A1 * 2/2003 Jennings ..... F23D 14/045 126/39 R
2004/0029063 A1 * 2/2004 Bettinzoli ..... F24C 3/085 431/354
2004/0195399 A1 * 10/2004 Molla ..... F23D 14/06 239/594
2005/0145239 A1 * 7/2005 Bettinzoli ..... F24C 3/085 126/39 E
2005/0202361 A1 * 9/2005 Albizuri ..... F23N 1/007 431/354
2007/0007482 A1 * 1/2007 DeHaan ..... F16K 5/0242 251/310
2008/0202494 A1 * 8/2008 Paesani ..... F23D 14/065 126/39 E
2008/0206697 A1 * 8/2008 Trochou ..... F23D 14/06 431/284
2010/0089384 A1 * 4/2010 Inzaghi ..... F24C 3/085 126/39 E
2010/0101557 A1 * 4/2010 Gasparini ..... F24C 3/00 126/39 E
2011/0048400 A1 * 3/2011 Biagioli ..... F23D 14/06 126/39 E
2013/0014744 A1 * 1/2013 Hensley ..... F24C 3/08 126/39 E
2013/0199513 A1 * 8/2013 Bettinzoli ..... F23D 14/64 126/39 E
2013/0306055 A1 * 11/2013 Cadima ..... F24C 3/085 126/39 E
2013/0334446 A1 * 12/2013 Gur ..... F16K 5/0414 251/122
2015/0034070 A1 * 2/2015 Fogolin ..... F23D 14/06 126/39 E
2015/0308677 A1 * 10/2015 Brouard ..... F23D 14/28 126/39 E
2015/0345800 A1 * 12/2015 Cabrera Botello ..... F23D 14/06 126/39 E
2016/0091210 A1 * 3/2016 Ceccoli ..... F23D 23/00 126/216
2016/0201921 A1 * 7/2016 Muller ..... F23D 14/56 126/39 E
2017/0370575 A1 12/2017 Rasi
2018/0073730 A1 * 3/2018 Acosta Herrero ..... F24C 3/085
2018/0135852 A1 * 5/2018 Martin ..... F23D 14/06
2018/0245720 A1 * 8/2018 Leeseberg ..... F16L 13/147
2018/0320903 A1 * 11/2018 Cadima ..... F23D 14/84
2018/0347808 A1 * 12/2018 Trochou ..... F24C 3/08
2019/0056115 A1 * 2/2019 Cadima ..... F24C 3/124
2019/0056116 A1 * 2/2019 Cadima ..... F24C 3/008
2019/0107287 A1 * 4/2019 Kitabayashi ..... F23D 14/08
2019/0145626 A1 * 5/2019 Cadima ..... F23D 14/065 126/39 E
2019/0346135 A1 * 11/2019 Cadima ..... F23N 5/105

FOREIGN PATENT DOCUMENTS

CN 201443763 4/2010
CN 201811305 4/2011
CN 104913302 9/2015
CN 106352334 1/2017
JP 2000314510 A 11/2000
WO WO 2015114495 8/2015

* cited by examiner

EDUCTOR FOR A GAS COOKTOP APPLIANCE

FIELD OF THE INVENTION

The present subject matter relates generally to cooktop appliances with gas burners.

BACKGROUND OF THE INVENTION

Certain cooktop appliances include gas burners for heating pots, pans, griddles, etc. High power gas burners are particularly useful for cooking but require a large volume of air to burn cleanly. Various factors affect performance of high power gas burners, including mixing of the large volume of air with fuel prior to combustion. One mechanism to improve air and fuel mixing prior to combustion is to mix a stream of pressurized air with a stream of pressurized fuel using an eductor. High power gas burners supplied with pressurized air offer an increased volume of air and thus increased power relative to naturally aspirated gas burners. However, high power gas burners with an eductor pose challenges.

Cooktop appliances are frequently sold configured to burn natural gas and must be converted to burn propane. The conversion from natural gas to propane generally requires an installer to switch the gas orifices within the cooktop appliance to propane gas orifices. At the eductor, a fuel line must be removed to access and switch the gas orifice. Removing the fuel line is undesirable and challenging for the unskilled, such as a homeowner.

Another mechanism to improve air entrainment is to use a long mixing throat, which also provides an increased residence time for mixing air and fuel. Long mixing throats can facilitate formation of a homogeneous mixture prior to combustion without significant pressure loss. However, high power gas burners with long mixing throats have certain drawbacks.

Long mixing throats are frequently horizontally oriented within the cooktop appliance due to space constraints. Thus, the horizontal mixing throat positions the eductor's fuel orifice far from its burner head. The installer is required to disassemble the cooktop to access and switch out the fuel orifice, and switching out the fuel orifices in cooktop appliances requiring disassembly of the cooktop is tedious and time consuming.

BRIEF DESCRIPTION OF THE INVENTION

Aspects and advantages of the invention will be set forth in part in the following description, or may be apparent from the description, or may be learned through practice of the invention.

In a first example embodiment, an eductor for a gas burner includes a mixing body that defines a mixing chamber. The mixing body also has a fuel line coupling. The mixing chamber is configured for receiving a flow of forced air and a flow of fuel. The fuel line coupling is configured for supporting a fuel line through which the flow of fuel enters the mixing body. A fuel metering orifice is mounted to the mixing body. The fuel metering orifice is spaced from the fuel line coupling on the mixing body. The fuel metering orifice is configured for directing the flow of fuel into the mixing chamber of the mixing body. The fuel metering orifice is separable from the mixing body when the fuel line is coupled to the mixing body at the fuel line coupling.

In a second example embodiment, an eductor for a gas burner includes a mixing body that defines a mixing chamber. The mixing body also has a forced air coupling and a fuel line coupling. The mixing chamber is configured for receiving a flow of forced air from the forced air coupling and a flow of fuel from the fuel line coupling. The fuel line coupling is configured for supporting a fuel line through which the flow of fuel enters the mixing body. A fuel metering orifice is mounted to the mixing body. The fuel metering orifice is spaced from the fuel line coupling on the mixing body. The fuel metering orifice is configured for directing the flow of fuel into the mixing chamber of the mixing body. The fuel metering orifice is configured such that the fuel metering orifice and the fuel line coupling are separately removable from the mixing body when the fuel line is coupled to the mixing body at the fuel line coupling.

In a third example embodiment, a cooktop appliance includes a top panel that defines an opening. A first gas burner is positioned on the top panel at the opening of the top panel. A second gas burner includes a burner body, a horizontal mixing tube and an eductor. The eductor includes a mixing body that defines a mixing chamber and a fuel line coupling. The mixing chamber is configured for receiving a flow of forced air and a flow of fuel. The fuel line coupling is configured for supporting a fuel line through which the flow of fuel enters the mixing body. A fuel metering orifice is mounted to the mixing body. The fuel metering orifice is spaced from the fuel line coupling on the mixing body. The fuel metering orifice is configured for directing the flow of fuel into the mixing chamber of the mixing body. The fuel metering orifice is separable from the mixing body when the fuel line is coupled to the mixing body at the fuel line coupling.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
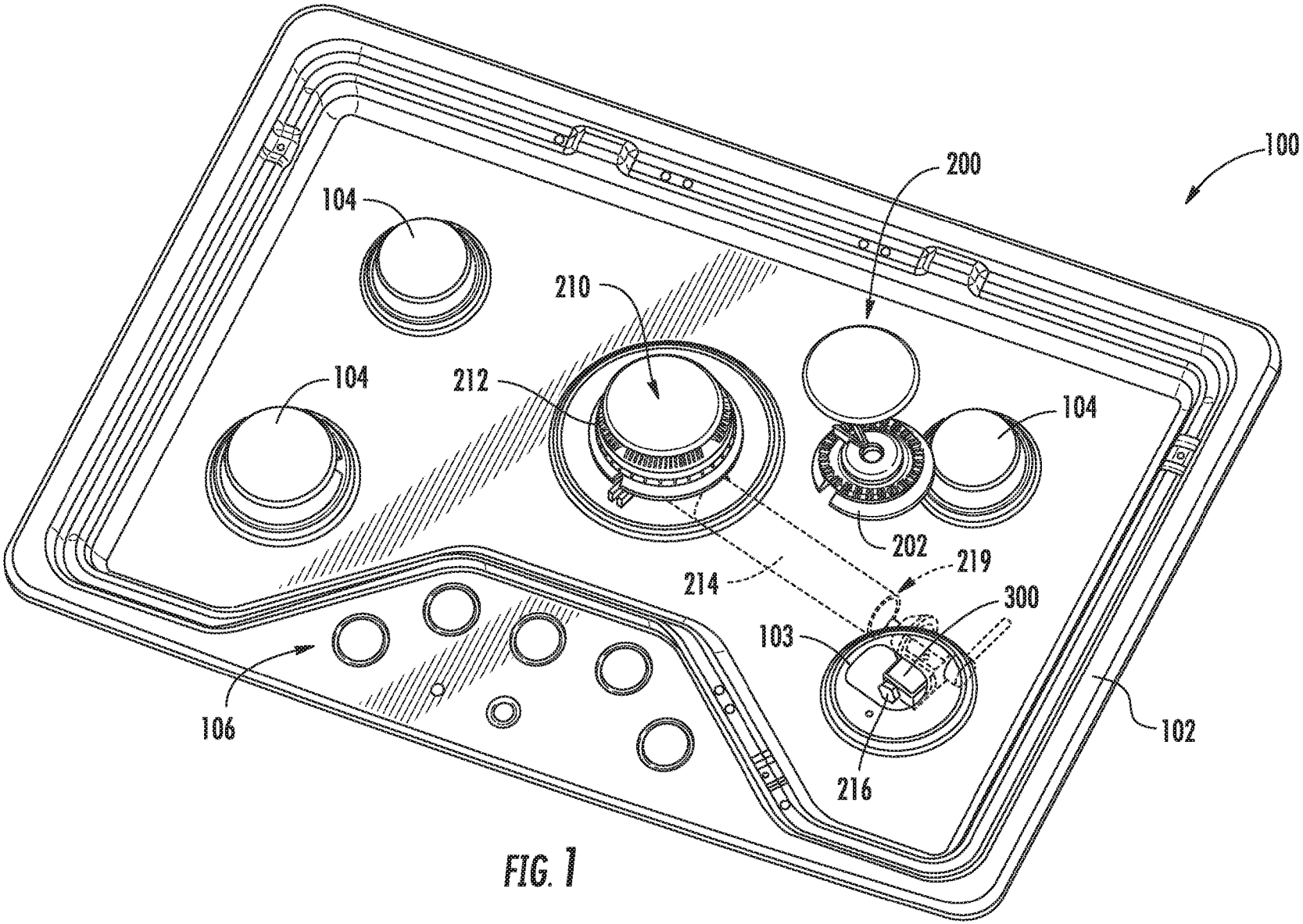
FIG. 1 provides a partially exploded, perspective view of a cooktop appliance according to an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner assembly for a cooktop appliance 100. Although cooktop appliance 100 is used below for the purpose of explaining the details of the present subject matter, it will be appreciated that the present subject matter may be used in or with any other suitable appliance in alternative example embodiments. For example, the gas burner assembly described below may be used on other types of cooking appliances, such as single or double oven range appliances. Cooktop appliance 100 is used in the discussion below only for the purpose of explanation, and such use is not intended to limit the scope of the present disclosure to any particular style of appliance.

FIG. 1 illustrates an example embodiment of a cooktop appliance 100 of the present disclosure. Cooktop appliance 100 may be, e.g., fitted integrally with a surface of a kitchen counter or may be configured as a slide-in cooktop unit. Cooktop appliance 100 includes a top panel 102 that includes one or more heating sources, such as heating elements 104 for use in, e.g., heating or cooking. In general, top panel 102 may be constructed of any suitably rigid and heat resistant material capable of supporting heating elements 104, cooking utensils, grates, and/or other components of cooktop appliance 100. By way of example, top panel 102 may be constructed of enameled steel, stainless steel, glass, ceramics, and combinations thereof.

According to the illustrated example embodiment, a user interface panel or control panel 106 is located within convenient reach of a user of cooktop appliance 100. For this example embodiment, control panel 106 includes control knobs (not shown) that are each associated with one of heating elements 104. The control knobs allow the user to activate each heating element 104 and regulate the amount of heat input each heating element 104 provides to a cooking utensil located thereon, as described in more detail below. Although cooktop appliance 100 is illustrated as is configured to include control knobs for controlling heating elements 104, it will be understood that the configuration of cooktop appliance 100 shown in FIG. 1 is provided by way of example only. More specifically, control panel 106 may include various input components, such as one or more of a variety of touch-type controls, electrical, mechanical or electro-mechanical input devices including rotary dials, push buttons, and touch pads.

Cooktop appliance 100 is generally referred to as "a gas cooktop," and heating elements 104 are gas burners, such as a gas burner assembly 210 described below. As illustrated, heating elements 104 are positioned on and/or within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates (not shown) configured to support a cooking utensil, such as a pot, pan, etc. In general, the grates may include a plurality of elongated members, e.g., formed of cast metal, such as cast iron. The cooking utensil may be placed on the elongated members of each grate such that the cooking utensil rests on an upper surface of the elongated members during the cooking process. Heating elements 104 are positioned underneath the various grates such that heating elements 104 provide thermal energy to cooking utensils above top panel 102 by combustion of fuel below the cooking utensils.

As shown in FIG. 1, heating elements 104 includes a first gas burner 200 and a second gas burner 210. In FIG. 1, first gas burner 200 is removed from top panel 102. An opening 103 in top panel 102 is revealed when first heating element 200 is removed from top panel 102. A burner body 202 of first gas burner 200 that defines flame ports of first gas burner 200 may be positioned on top panel 102 at opening 103 of top panel 102. Thus, e.g., burner body 202 of first gas burner 200 may rest on top panel 102 such that burner body 202 of first gas burner 200 covers opening 103.

Figure 2:
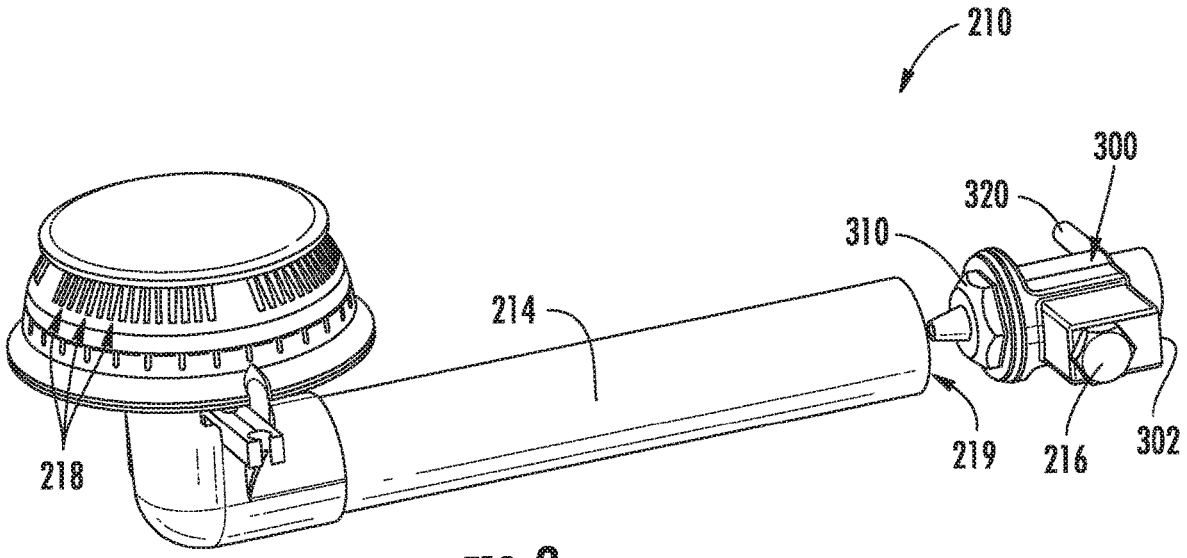
FIG. 2 is a perspective view of a gas burner according to an example embodiment of the present disclosure.
Figure 3:
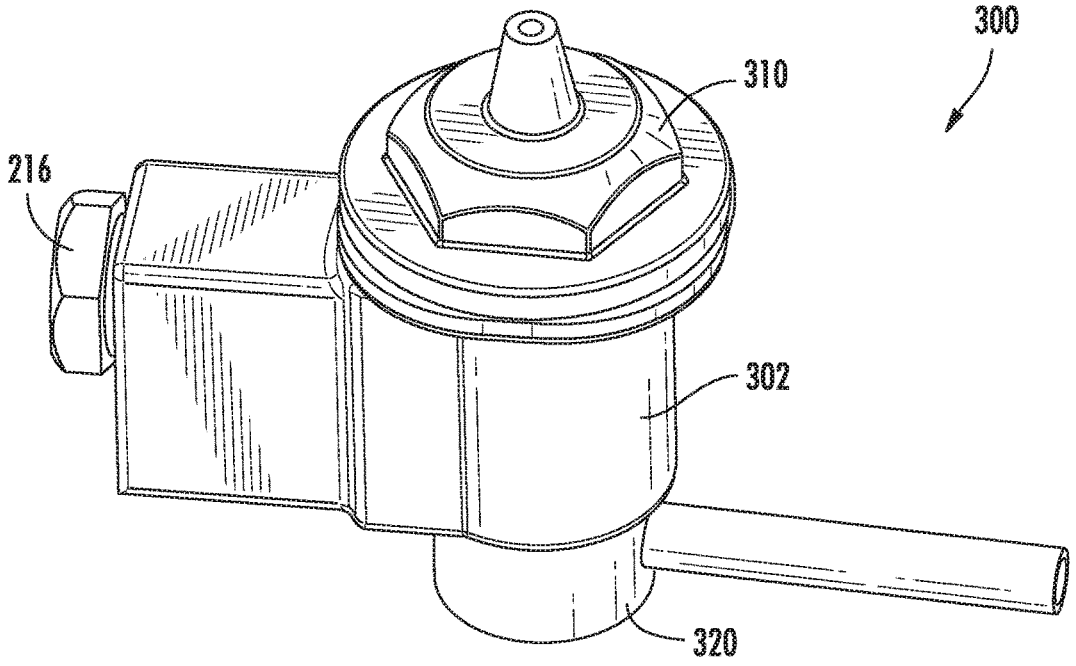
FIG. 3 is a perspective view of an eductor of the example gas burner of FIG. 2.
Figure 4:
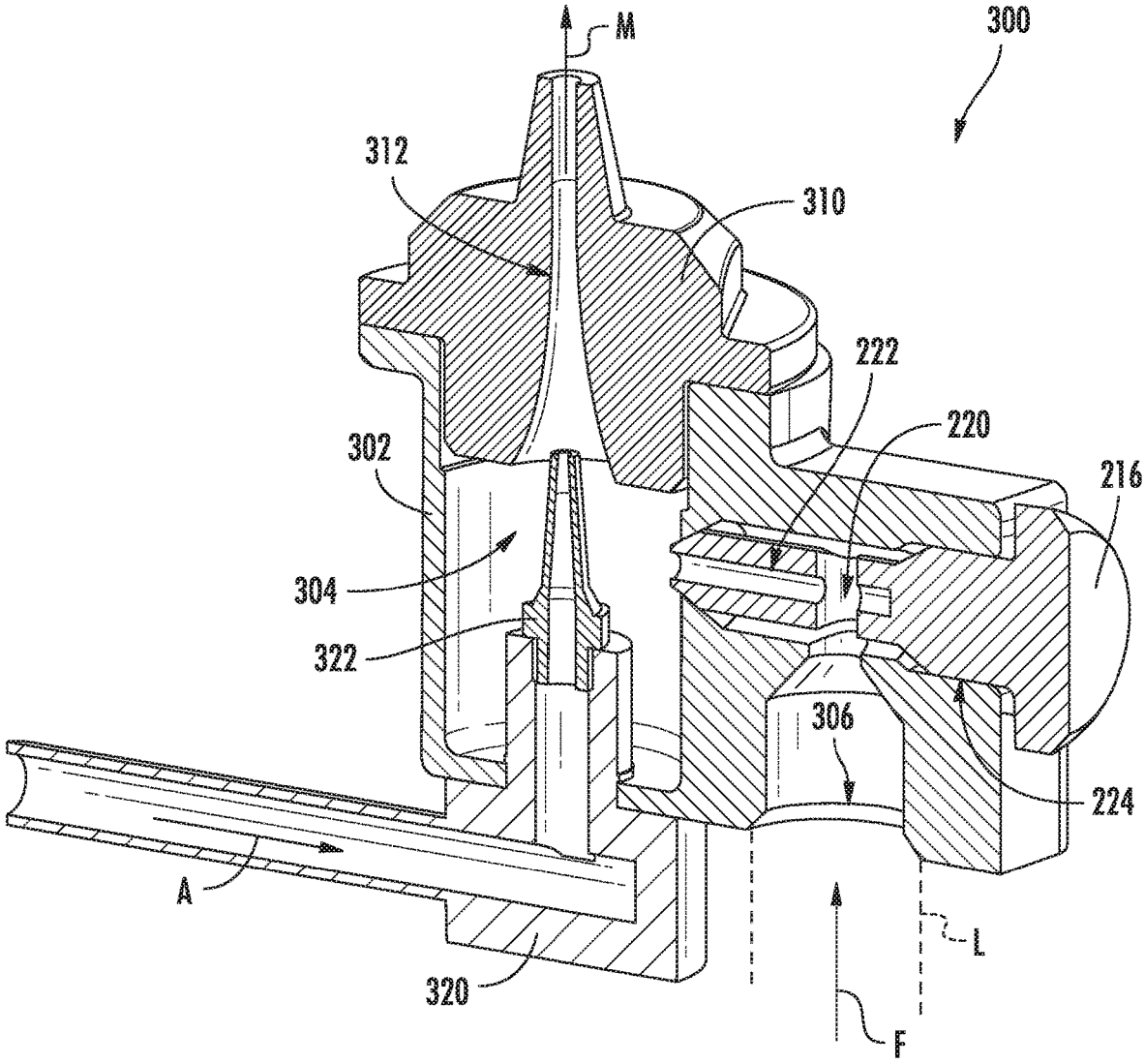
FIG. 4 is a section view of the eductor of FIG. 3.
Figure 5:
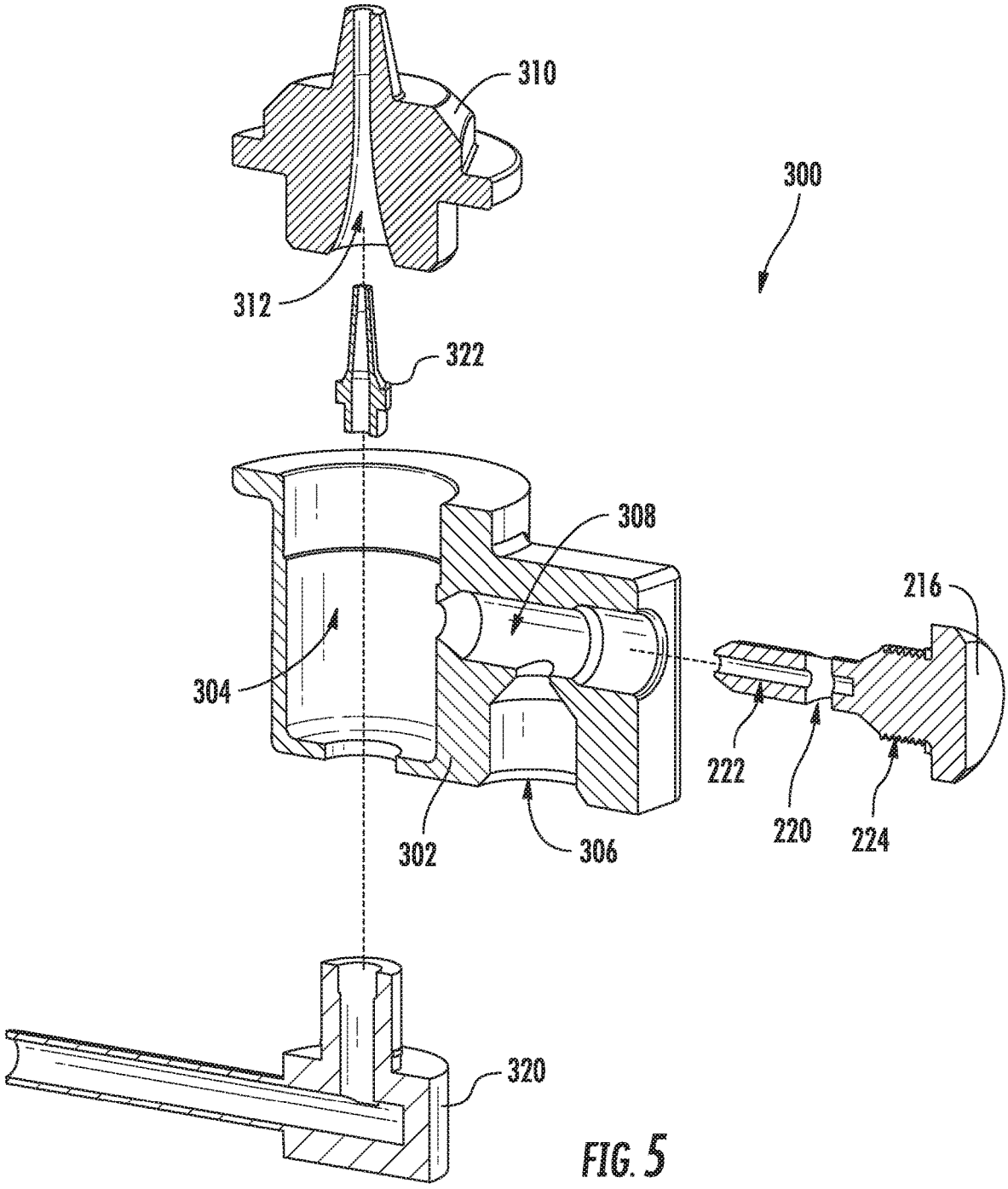
FIG. 5 is an exploded, section view of the eductor of FIG. 3.
Figure 6:
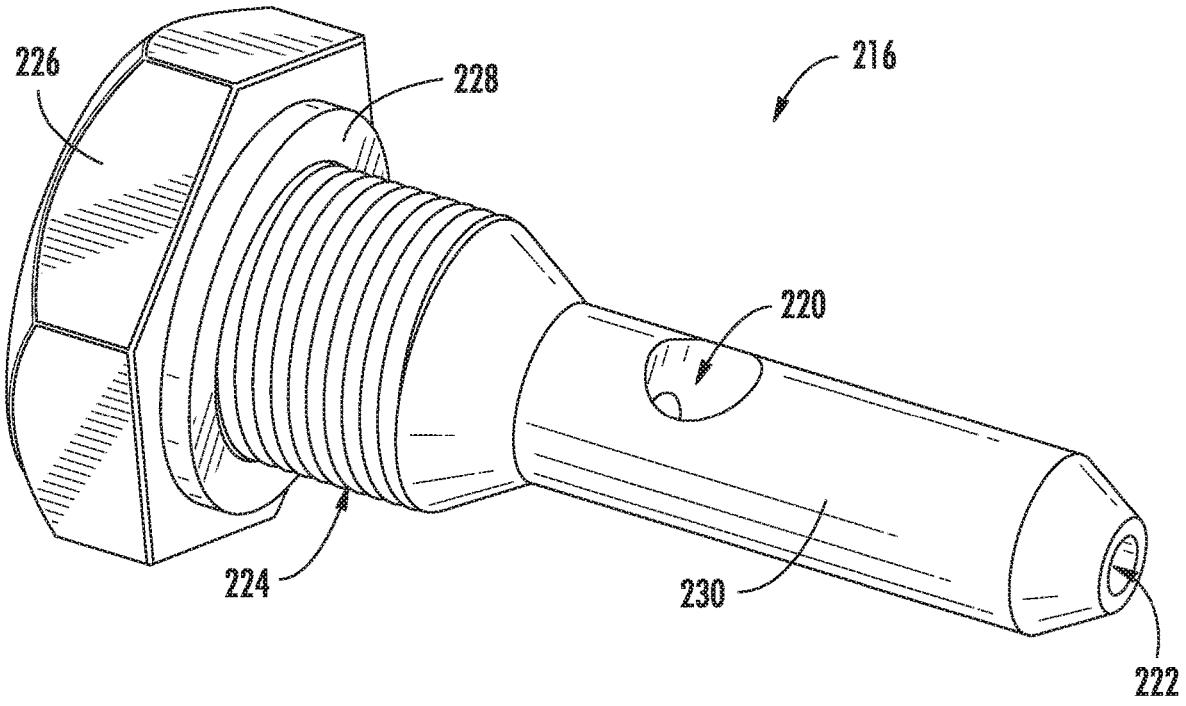
FIG. 6 is a perspective view of a fuel metering orifice of the eductor of FIG. 3.

As shown in FIG. 2, second gas burner 210 includes a burner body 212, a horizontal mixing tube 214 and a fuel metering orifice 216. Burner body 212 of second gas burner 210 defines a plurality of flame ports 218. During operation of second gas burner 210, a mixture of gaseous fuel and air may flow out of burner body 212 of second gas burner 210 through flame ports 218, and the mixture of gaseous fuel and air may be combusted outside of flame ports 218. Second gas burner 210 may be operated independently of first gas burner 200. Thus, e.g., fuel flow through fuel orifice 206 of first gas burner 200 and fuel flow through fuel metering orifice 216 of second gas burner 210 may each be regulated with a respective one of the control knobs.

Turning back to FIG. 1, burner body 212 of second gas burner 210 is positioned on top panel 102 away from opening 103 of top panel 102. Thus, e.g., burner body 212 of second gas burner 210 may rest on top panel 102 such that burner body 212 of second gas burner 210 is spaced apart from opening 103. For example, burner body 212 of second gas burner 210 may be positioned on top panel 102 such that burner body 212 of second gas burner 210 is spaced from opening 103 of top panel 102 (e.g., and burner body 202 of first gas burner 200) by no less than five inches (5") and no more than twenty inches (20").

Fuel metering orifice 216 of second gas burner 210 is positioned below top panel 102. In particular, fuel metering orifice 216 of second gas burner 210 may be positioned directly below opening 103 of top panel 102. Thus, fuel metering orifice 216 of second gas burner 210 may be accessible through opening 103 of top panel 102, and an installer may reach through opening 103 (e.g., with a wrench or other suitable tool) to change out fuel metering orifice 216 of second gas burner 210.

Horizontal mixing tube 214 is positioned below top panel 102. Horizontal mixing tube 214 extends in a generally horizontal manner between burner body 212 of second gas burner 210 and an eductor 300 of second gas burner 210. Fuel metering orifice 216 of second gas burner 210 is mounted to eductor 300, as discussed in greater detail below. An inlet 219 of horizontal mixing tube 214 is positioned adjacent an outlet nozzle 310 of eductor 300. In particular, an inlet 219 of horizontal mixing tube 214 may be spaced from and aligned (e.g., concentrically) with outlet nozzle 310 of eductor 300. Thus, a flow of gaseous fuel and air from outlet nozzle 310 of eductor 300 may flow horizontally into horizontal mixing tube 214 at inlet 219 of horizontal mixing tube 214. Between outlet nozzle 310 of eductor 300 and inlet 219 of horizontal mixing tube 214, the flow of gaseous fuel and air may entrain additional air to facilitate combustion at flame ports 218. Horizontal mixing tube 214 may be a horizontal Venturi mixing tube with a suitable inner surface geometry to form an injector with the Venturi effect of a converging-diverging nozzle.

Second gas burner 210 may be configured such that second gas burner 210 has a greater maximum heat output than first gas burner 200. For example, the longer horizontal mixing tube 214 provides greater entrainment of air relative to a shorter vertical mixing tube of first gas burner 200. The longer horizontal mixing tube 214 may also provide additional time mixing for gaseous fuel and air relative to the shorter vertical mixing tube of first gas burner 200 without adding significant pressure losses.

As may be seen from the above, cooktop appliance 100 includes features for accessing fuel metering orifice 216 of second gas burner 210 through top panel 102. In particular, fuel metering orifice 216 of second gas burner 210 may be accessible through opening 103. Thus, an installer can simply remove burner body 202 of first gas burner 200 from top panel 102 to reveal opening 103 of top panel 102, and the installer may reach through opening 103 to access and manipulate fuel metering orifice 216. The installer switching fuel metering orifice 216 need not remove cooktop appliance 100 from an associated cabinet or significantly disassemble cooktop appliance 100 to switch fuel metering orifice 216, e.g., between a natural gas metering orifice and a propane metering orifices. Thus, fuel metering orifice 216 may be switch out more easily in cooktop appliance 100 compared to known cooktops.

Additional features of cooktop appliance 100 that assist with switching second gas burner 210 of cooktop appliance 100 between fuel sources are discussed in greater detail below. Turning to FIGS. 3 through 6, eductor 300 includes a mixing body 302. Mixing body 302 defines a mixing chamber 304. Within mixing chamber 304, gaseous fuel and air are mixed prior to exiting mixing body 302 at outlet nozzle 310 of eductor 300. Mixing body 302 may be formed of or with a suitable material, such casted or additively formed metal or plastic, in order to form mixing chamber 304 within mixing body 302.

Mixing body 302 also has a fuel line coupling 306 and a forced air coupling 320. Mixing chamber 304 is configured for receiving a flow of forced air (shown with arrow A in FIG. 4) from forced air coupling 320 and a flow of fuel (shown with arrow F in FIG. 4) from fuel line coupling 306. In particular, forced air coupling 320 may be connected to a pressurized air source, such as a fan, pump, etc., that is operable to generate air that is pressurized relative to ambient air about eductor 300. The flow of air A enters mixing chamber 304 through a forced air nozzle 322 of forced air coupling 320. Forced air nozzle 322 may be shaped (e.g., with a converging cross-section) to increase a velocity of the flow of air A into mixing chamber 304. Within mixing chamber 304, the flow of air A from forced air nozzle 322 into mixing chamber 304 acts as a motive fluid for the flow of fuel F into mixing chamber 304.

Fuel line coupling 306 may be connected to a fuel line L (shown schematically in FIG. 4) that in turn is connected to a fuel source, such as a propane tank or a natural gas line. As an example, fuel line L may be staked, threaded, etc. to mixing body 302 at fuel line coupling 306. Thus, pressurized gaseous fuel may flow into mixing body 302 at fuel line coupling 306 from fuel line L. Within mixing chamber 304, the flow of forced air A mixes with the flow of fuel F prior to exiting mixing chamber 304 as a mixed flow of air and fuel (shown with arrow M in FIG. 4) through outlet nozzle 310. As noted above, outlet nozzle 310 may be oriented towards horizontal mixing tube 214. Outlet nozzle 310 may be shaped (e.g., with a converging cross-section) to increase a velocity of the mixed flow of air and fuel M out of mixing chamber 304.

Fuel metering orifice 216 is mounted to mixing body 302. For example, an elongated cylinder 230 (FIG. 6) of fuel metering orifice 216 may be positioned within a cylindrical passage 308 (FIG. 5) of mixing body 302. Fuel metering orifice 216 may be threaded to mixing body 302 in certain example embodiments. As an example, a threaded outer surface 224 of may be threaded to mixing body 302. For example, a technician may utilize a wrench on a hex head 226 (FIG. 6) of fuel metering orifice 216 to rotate fuel metering orifice 216 relative to mixing body 302 and thereby mount fuel metering orifice 216 to mixing body 302. When fuel metering orifice 216 is mounted to mixing body 302, a gasket or O-ring 228 may be compressed between fuel metering orifice 216 (e.g., hex head 226) and mixing body 302. O-ring 228 may assist with sealing fuel metering orifice 216 within cylindrical passage 308 to thereby prevent fuel leakage from eductor 300.

Fuel metering orifice 216 is spaced from fuel line coupling 306 on mixing body 302 when fuel metering orifice 216 is mounted to mixing body 302. Thus, fuel line coupling 306 may be separate from fuel metering orifice 216 on mixing body 302. For example, fuel line coupling 306 may be integrally formed with mixing body 302, and fuel metering orifice 216 may be formed of or with a separate piece of material from mixing body 302. In addition, fuel metering orifice 216 is configured for directing the flow of fuel F into mixing chamber 304 of mixing body 302. For example, from fuel line coupling 306, the flow of fuel F may pass through fuel metering orifice 216 prior to flowing into mixing chamber 304 within mixing body 302. Passages within fuel metering orifice 216 may be sized to regulate the flow of fuel F into mixing chamber 304.

Fuel metering orifice 216 is separable from mixing body 302 when fuel line L is coupled to mixing body 302 at fuel line coupling 306. Thus, e.g., fuel line L need not be removed from mixing body 302 in order to remove fuel metering orifice 216 from mixing body 302. Rather, fuel metering orifice 216 and fuel line L are separately removable from mixing body 302. By mounting fuel metering orifice 216 to mixing body 302 separate from fuel line L, converting eductor 300 between different fuels (i.e., different gas metering orifices) may be done without disconnecting fuel line L from mixing body 302. For example, a technician may simply remove fuel metering orifice 216 from mixing body 302 without disconnecting fuel line L and then service or replace fuel metering orifice 216.

Fuel metering orifice 216 may define an inlet passage 220 and an outlet passage 222. Inlet passage 220 may be contiguous with an interior of fuel line coupling 306 and be configured to receive the flow of fuel F from the fuel line L at fuel line coupling 306. In contrast, outlet passage 222 may be contiguous with mixing chamber 304 and be configured to direct the flow of fuel F out of fuel metering orifice 216 and into mixing chamber 304. Inlet passage 220 may also be positioned coaxial with fuel line L when fuel line L is coupled to mixing body 302 at fuel line coupling 306. Conversely, outlet passage 222 may be positioned coaxial with threaded outer surface 224 of fuel metering orifice 216. The flow of fuel F within inlet passage 220 may also be perpendicular to the flow of fuel F within outlet passage 222 inside fuel metering orifice 216.

Inlet and outlet passages 220, 222 extend within fuel metering orifice 216 such that inlet passage 220 is oriented perpendicular to outlet passage 222 in fuel metering orifice 216. It will be understood that inlet passage 220 need not be oriented at exactly ninety degrees (90°) to outlet passage 222 in certain example embodiments. Rather, the term "perpendicular" as used herein includes a ten degree margin (i.e., 90°±10°). Thus, inlet passage 220 may be oriented generally perpendicular to outlet passage 222 within fuel metering orifice 216.

Fuel metering orifice 216 may be machined or additively formed metal or plastic. For example, inlet passage 220 and outlet passage 222 may be separately drilled into elongated cylinder 230 of fuel metering orifice 216. Thus, inlet passage 220 and outlet passage 222 may be cross drilled within fuel metering orifice 216.

Eductor 300 described above may be advantageously produced for use in cooktop 100. Eductor 300 also includes various features that facilitate servicing and/or changing of fuel metering orifice 216. For example, eductor 300 may be serviced without the need to remove a leak free gas line, such as fuel line L. In addition, eductor 300 may be accessible through top panel 102 at opening 103, e.g., to allow servicing and/or changing of fuel metering orifice 216, from above top panel 102 without the requiring remove of cooktop 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An eductor for a gas burner, comprising:

a mixing body defining a mixing chamber, the mixing body having a fuel line coupling, the mixing chamber configured for receiving a flow of forced air and a flow of fuel, the fuel line coupling configured for supporting a fuel line through which the flow of fuel enters the mixing body, a forced air nozzle positioned on the mixing body at the mixing chamber and configured for directing the flow of forced air into the mixing chamber, the forced air nozzle having a converging cross-section for increasing a velocity of the flow of forced air into the mixing chamber, an outlet nozzle positioned on the mixing body at the mixing chamber and configured for directing a mixed flow of air and fuel out of the mixing chamber, the outlet nozzle having a converging cross-section for increasing a velocity of the mixed flow of air and fuel out of the mixing chamber;

a fuel metering orifice mounted to the mixing body downstream of the fuel line coupling and upstream of the mixing chamber relative to the flow of fuel, the fuel metering orifice spaced from the fuel line coupling on the mixing body, the fuel metering orifice configured for directing the flow of fuel into the mixing chamber of the mixing body, wherein the fuel metering orifice is separable from the mixing body when the fuel line is coupled to the mixing body at the fuel line coupling, wherein the fuel metering orifice is formed from a separate piece of material from the mixing body, and the fuel metering orifice defines an inlet passage and an outlet passage within the separate piece of material.

2. The eductor of claim 1, wherein the inlet and outlet passages extend within the fuel metering orifice such that the inlet passage is oriented perpendicular to the outlet passage.

3. The eductor of claim 2, wherein the inlet passage is contiguous with an interior of the fuel line when the fuel line is coupled to the mixing body at the fuel line coupling.

4. The eductor of claim 2, wherein the outlet passage is positioned coaxial with a threaded outer surface of the fuel metering orifice at which the fuel metering orifice is threaded to the mixing body.

5. The eductor of claim 1, wherein the flow of fuel within the inlet passage is perpendicular to the flow of fuel within the outlet passage.

6. The eductor of claim 5, wherein the inlet passage is contiguous with an interior of the fuel line when the fuel line is coupled to the mixing body at the fuel line coupling.

7. The eductor of claim 5, wherein the outlet passage is positioned coaxial with a threaded outer surface of the fuel metering orifice at which the fuel metering orifice is threaded to the mixing body.

8. An eductor for a gas burner, comprising:

a mixing body defining a mixing chamber, the mixing body having a forced air coupling and a fuel line coupling, the mixing chamber configured for receiving a flow of forced air from the forced air coupling and a flow of fuel from the fuel line coupling, the fuel line coupling configured for supporting a fuel line through which the flow of fuel enters the mixing body, a forced air nozzle positioned on the mixing body at the mixing chamber and configured for directing the flow of forced air into the mixing chamber, the forced air nozzle having a converging cross-section for increasing a velocity of the flow of forced air into the mixing chamber, an outlet nozzle positioned on the mixing body at the mixing chamber and configured for directing a mixed flow of air and fuel out of the mixing chamber, the outlet nozzle having a converging cross-section for increasing a velocity of the mixed flow of air and fuel out of the mixing chamber;

a fuel metering orifice mounted to the mixing body downstream of the fuel line coupling and upstream of the mixing chamber relative to the flow of fuel, the fuel metering orifice spaced from the fuel line coupling on the mixing body, the fuel metering orifice configured for directing the flow of fuel into the mixing chamber of the mixing body, wherein the fuel metering orifice is configured such that the fuel metering orifice and the fuel line coupling are separately removable from the mixing body when the fuel line is coupled to the mixing body at the fuel line coupling, wherein the fuel metering orifice is formed from a separate piece of material from the mixing body, and the fuel metering orifice defines an inlet passage and an outlet passage within the separate piece of material.

9. The eductor of claim 8, wherein the inlet and outlet passages extend within the fuel metering orifice such that the inlet passage is oriented perpendicular to the outlet passage.

10. The eductor of claim 9, wherein the inlet passage is contiguous with an interior of with the fuel line when the fuel line is coupled to the mixing body at the fuel line coupling.

11. The eductor of claim 9, wherein the outlet passage is positioned coaxial with a threaded outer surface of the fuel metering orifice at which the fuel metering orifice is threaded to the mixing body.

12. The eductor of claim 8, wherein the flow of fuel within the inlet passage is perpendicular to the flow of fuel within the outlet passage.

13. A cooktop appliance, comprising:

a top panel that defines an opening;

a first gas burner positioned on the top panel at the opening of the top panel;

a second gas burner comprising a burner body, a horizontal mixing tube and an eductor, the eductor comprising a mixing body defining a mixing chamber and a fuel line coupling, the mixing chamber configured for receiving a flow of forced air and a flow of fuel, the fuel line coupling configured for supporting a fuel line through which the flow of fuel enters the mixing body, a forced air nozzle positioned on the mixing body at the mixing chamber and configured for directing the flow of forced air into the mixing chamber, the forced air nozzle having a converging cross-section for increasing a velocity of the flow of forced air into the mixing chamber, an outlet nozzle positioned on the mixing body at the mixing chamber and configured for directing a mixed flow of air and fuel out of the mixing chamber, the outlet nozzle having a converging cross-section for increasing a velocity of the mixed flow of air and fuel out of the mixing chamber;

a fuel metering orifice mounted to the mixing body downstream of the fuel line coupling and upstream of the mixing chamber relative to the flow of fuel, the fuel metering orifice spaced from the fuel line coupling on the mixing body, the fuel metering orifice configured for directing the flow of fuel into the mixing chamber of the mixing body, wherein the fuel metering orifice is separable from the mixing body when the fuel line is coupled to the mixing body at the fuel line coupling, wherein the fuel metering orifice is formed from a separate piece of material from the mixing body, and the fuel metering orifice defines an inlet passage and an outlet passage within the separate piece of material.

14. The cooktop appliance of claim 13, wherein the inlet and outlet passages extend within the fuel metering orifice such that the inlet passage is oriented perpendicular to the outlet passage.

15. The cooktop appliance of claim 14, wherein the inlet passage is contiguous with an interior of the fuel line when the fuel line is coupled to the mixing body at the fuel line coupling.

16. The cooktop appliance of claim 14, wherein the outlet passage is positioned coaxial with a threaded outer surface of the fuel metering orifice at which the fuel metering orifice is threaded to the mixing body.

17. The cooktop appliance of claim 13, wherein the flow of fuel within the inlet passage is perpendicular to the flow of fuel within the outlet passage.

18. The cooktop appliance of claim 13, wherein the burner body is positioned on the top panel away from the opening of the top panel, the horizontal mixing tube positioned below the top panel and extending between the burner body and the eductor, the eductor positioned below the top panel at the opening of the top panel.

19. The cooktop appliance of claim 18, wherein the eductor is positioned below the opening of the top panel such that the fuel metering orifice of the eductor is accessible through the opening of the top panel.

20. The cooktop appliance of claim 19, wherein the fuel metering orifice of the eductor is accessible through the opening of the top panel such that the fuel metering orifice of the eductor is changeable between a natural gas metering orifice and a propane metering orifice through the opening of the top panel.

* * * * *